US010455946B1

(12) United States Patent
Wang

(10) Patent No.: US 10,455,946 B1
(45) Date of Patent: Oct. 29, 2019

(54) BACKREST HEIGHT ADJUSTING ASSEMBLY

(71) Applicant: Chih-Jen Wang, Tainan (TW)

(72) Inventor: Chih-Jen Wang, Tainan (TW)

( * ) Notice: Subject to any disclaimer, the term of this patent is extended or adjusted under 35 U.S.C. 154(b) by 0 days.

(21) Appl. No.: 15/982,075

(22) Filed: May 17, 2018

(51) Int. Cl.
*A47C 7/40* (2006.01)
*A47C 7/46* (2006.01)

(52) U.S. Cl.
CPC ..... *A47C 7/462* (2013.01); *A47C 7/402* (2013.01)

(58) Field of Classification Search
CPC .. A47C 7/462; A47C 7/402; B60N 2002/2204
See application file for complete search history.

(56) References Cited

U.S. PATENT DOCUMENTS 4,616,877 A * 10/1986 Slaats ..... A47C 7/402 297/353
4,632,458 A * 12/1986 Brown ..... A47C 7/402 248/404
5,405,189 A * 4/1995 Stumpf ..... A47C 7/402 297/353
5,904,400 A * 5/1999 Wei ..... A47C 1/03255 297/284.1
6,276,757 B1 * 8/2001 Brown ..... A47C 7/402 297/353
6,302,482 B1 * 10/2001 Moll ..... A47C 1/023 297/339
6,533,355 B2 * 3/2003 Broekhuis ..... A47C 3/265 297/353
7,434,887 B1 * 10/2008 Hsien ..... A47C 1/03 297/411.36
7,506,935 B1 * 3/2009 Lin ..... A47C 1/023 297/353
8,069,645 B2 * 12/2011 Mackert ..... A47C 1/025 297/354.12
8,690,249 B2 * 4/2014 Kang ..... A47C 7/402 297/353
9,144,319 B2 * 9/2015 Murphy ..... A47C 17/04
9,399,421 B2 * 7/2016 Lu ..... A47C 7/38
9,848,705 B2 * 12/2017 Probst ..... A47C 7/402

* cited by examiner

*Primary Examiner* — Philip F Gabler
(74) *Attorney, Agent, or Firm* — Alan D. Kamrath; Mayer & Williams PC

(57) ABSTRACT

A backrest height adjusting device includes a fixing seat fixed in relation to a chair seat and having at least one fixing post. A backrest includes at least one coupling sleeve coupled with the at least one fixing post. At least one gear is rotatably mounted to the fixing block fixed on the backrest and is coupled with a plurality of positioning grooves on the at least one fixing post. An elastic element biases a movable block to move relative to the fixing block in a vertical direction and biases the movable block to mesh with the at least one gear to retain the backrest in a selected height relative to the fixing seat. The movable block is actuatable to disengage from the plurality of teeth of the at least one gear to thereby permit the backrest to move in the vertical direction relative to the fixing seat.

9 Claims, 10 Drawing Sheets

BACKREST HEIGHT ADJUSTING ASSEMBLY

BACKGROUND OF THE INVENTION

The present invention relates to a backrest height adjusting assembly and, more particularly, to a height adjusting assembly for adjusting a height of a backrest while providing an excellent and reliable positioning effect.

A type of chair includes a backrest at a rear side of a seat to permit a user to lie his or her back against the backrest. The backrest is fixed to the seat or a chassis plate disposed on the bottom side of the seat. The backrest has a contour corresponding to the curvature of the back of the human body to provide improved lying comfort. However, the contour of the backrest cannot suit different users having different heights, failing to provide reliable lying comfort and failing to provide wide applications.

To solve the above drawbacks, a type of chair includes a backrest having a tube at a lower end thereof. A post is disposed on top of a chassis plate of the seat. The tube is coupled with the post, and a knob transversely extending through the tube is tightened to fix the height of the backrest relative to the seat. When height adjustment of the backrest is desired, the knob is released, the backrest is moved to a desired height, and the knob is re-tightened. The whole adjusting procedure is troublesome. Furthermore, the backrest could loosen and move downward if the knob is not tightened, failing to provide a reliable adjusting effect.

BRIEF SUMMARY OF THE INVENTION

An objective of the present invention is to provide a backrest height adjusting device that is easy to adjust and that provides a reliable positioning effect.

Another objective of the present invention is to provide a waist rest adjusting device for providing a comfortable waist supporting effect for the user.

A backrest height adjusting device according to the present invention includes a fixing seat including a lower end having a coupling portion adapted to be fixed in relation to a chair seat. The fixing seat includes at least one fixing post extending in a vertical direction. The at least one fixing post includes a plurality of positioning grooves spaced from each other in the vertical direction. A backrest includes a frame having a coupling seat at a central portion thereof for coupling with the fixing seat. The coupling seat includes at least one coupling sleeve coupled with the at least one fixing post. The at least one coupling sleeve includes a coupling hole extending in the vertical direction and having a lower end with an opening through which the at least one fixing post extends. The at least one coupling sleeve includes a sidewall having a notch intercommunicated with the coupling hole and aligned with the plurality of positioning grooves of the at least one fixing post. The coupling seat includes a coupling portion. An adjusting device includes a fixing block, at least one gear, a movable block, and an elastic element. The fixing block is mounted to the coupling portion of the backrest and includes at least one pivotal portion. The at least one gear includes a plurality of teeth on an outer periphery thereof and is rotatably mounted to the at least one pivotal portion of the fixing block. A portion of the plurality of teeth extends through the notch of the at least one coupling sleeve and is coupled with a portion of the plurality of positioning grooves of the fixing seat. The movable block is movable in the movable in the vertical direction relative to the fixing block and includes a toothed portion. The elastic element biases the movable block to move relative to the fixing block and biases the toothed portion of the movable block to mesh with the at least one gear to retain the backrest in a selected height relative to the fixing seat. The movable block is actuatable to disengage the toothed portion from the plurality of teeth of the at least one gear to thereby permit the backrest to move in the vertical direction relative to the fixing seat, permitting height adjustment of the backrest relative to the fixing seat.

In an example, the at least one fixing post of the fixing seat includes two fixing posts parallel to each other. Each of the two fixing posts includes an inner face having the plurality of positioning grooves. The inner faces of the two fixing posts face each other. The at least one coupling sleeve of the coupling seat of the backrest includes two coupling sleeves respectively coupled with the two fixing posts. The fixing block includes a main plate. The at least one pivotal portion of the fixing block includes two pivotal portions respectively disposed on two sides of the main plate. The at least one gear includes two gears respectively and rotatably mounted to the two pivotal portions. The plurality of teeth of each of the two gears meshes with the plurality of positioning grooves of one of the two fixing posts. The movable block includes two shoulders. Each of the two shoulders of the movable block includes a bottom side having the toothed portion. The toothed portion of each of the two shoulders meshes with a portion of the plurality of teeth of one of the two gears.

In an example, each of the two fixing posts includes a groove disposed above the plurality of positioning grooves thereof and having a width larger than a width of each of the plurality of positioning grooves. Some of the plurality of teeth of each of the two gears are received in the groove of one of the two fixing posts when the backrest is in a highest position relative to the fixing seat.

In an example, the main plate of the fixing block includes two guiding pegs on a rear surface thereof. The main plate further includes two elongated guiding grooves in a bottom side thereof. The movable block is in a form of a plate and includes two elongated guiding slots and two stubs. The two guiding pegs are slideably received in the two elongated guiding slots. The two stubs are slideably received in the two elongated guiding grooves.

In an example, the main plate includes an upper abutting portion protruding from the rear surface of the main plate. The movable block further includes a central portion having an upper end with a recessed portion. The recessed portion has a lower abutting portion. The elastic element is a compression spring and is received in the recessed portion of the movable block. The elastic element includes upper and lower ends respectively abutting the upper abutting portion and the lower abutting portion. A fixing rod extends through the upper abutting portion, the elastic element, and the lower abutting portion to position the elastic element.

In an example, the adjusting device further includes an actuation block mounted below the fixing block and the movable block. The actuation block includes a receiving space in an upper side thereof. A bottom of the fixing block and a bottom of the movable block are received in the receiving space. The actuation block further includes two tabs extending upward from a wall of the receiving space. Each of the two tabs has a through-hole. Two fasteners respectively extend through the two stubs of the movable block and the through-holes of the two tabs, permitting joint movement of the actuation block and the movable block.

In an example, each of the two pivotal portions of the fixing block includes a pivotal plate extending parallel to and spaced from the rear surface of the main plate. Each pivotal plate and the rear surface of the main plate have a receiving groove therebetween. The main plate has two pivot holes. Each pivotal plate has a pivot hole aligned with one of the two pivot holes of the main plate. The two gears are respectively received in the receiving grooves. Each of the two gears has an axial hole in a center thereof. Two pins respectively extend through the two pivot holes of the main plate, the axial holes of the two gears, and the pivot holes of the pivotal plates.

In an example, the backrest height adjusting assembly further includes a waist rest. The coupling seat of the backrest includes a front side having two insertion portions. Each of the two insertion portions includes a plurality of insertion holes spaced from each other in the vertical direction. The waist rest includes an abutment plate portion and a connecting portion. The connecting portion includes a front side connected to the abutment plate portion. The connecting portion further includes at least one insertion peg. The number of the at least one insertion peg is smaller than the number of the plurality of insertion holes. The at least one insertion peg is selectively engaged with at least one of the plurality of insertion holes to selectively fix the waist rest in a selected height relative to the backrest.

In an example, the abutment plate portion includes a first plate and a second plate. The first plate and the second plate are arranged in the vertical direction. The connecting portion is mounted between the first plate and the second plate. A first connecting plate and a second connecting plate protrude from a front side of the connecting portion and are respectively connected to the first plate and the second plate. A spacing between the first connecting plate and the second connecting plate increases forward from rear ends toward front ends of the first and second connecting plates. The rear ends of the first connecting plate and the second connecting plate are connected by an engagement piece. The at least one insertion peg is disposed at a rear side of the engagement piece.

The present invention will become clearer in light of the following detailed description of illustrative embodiments of this invention described in connection with the drawings.

DESCRIPTION OF THE DRAWINGS

FIG. 5A is an enlarged view of a circled portion of FIG. 5.

FIG. 6A is an enlarged view of a circled portion of FIG. 6.

DETAILED DESCRIPTION OF THE INVENTION

Figure 1:
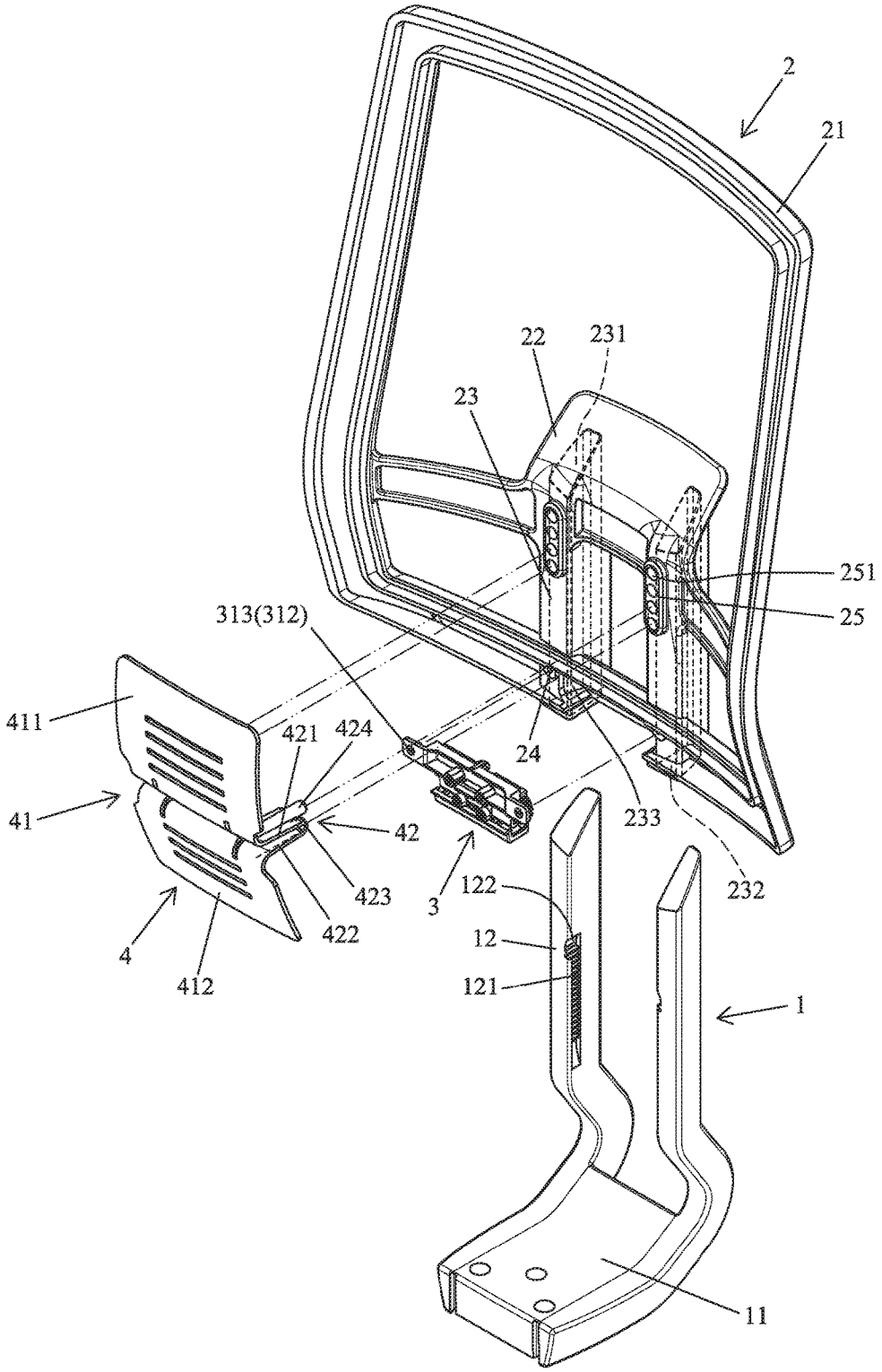
FIG. 1 is a perspective view of a backrest height adjusting assembly of an embodiment according to the present invention, with the backrest height adjusting device including a waist rest.
Figure 2:
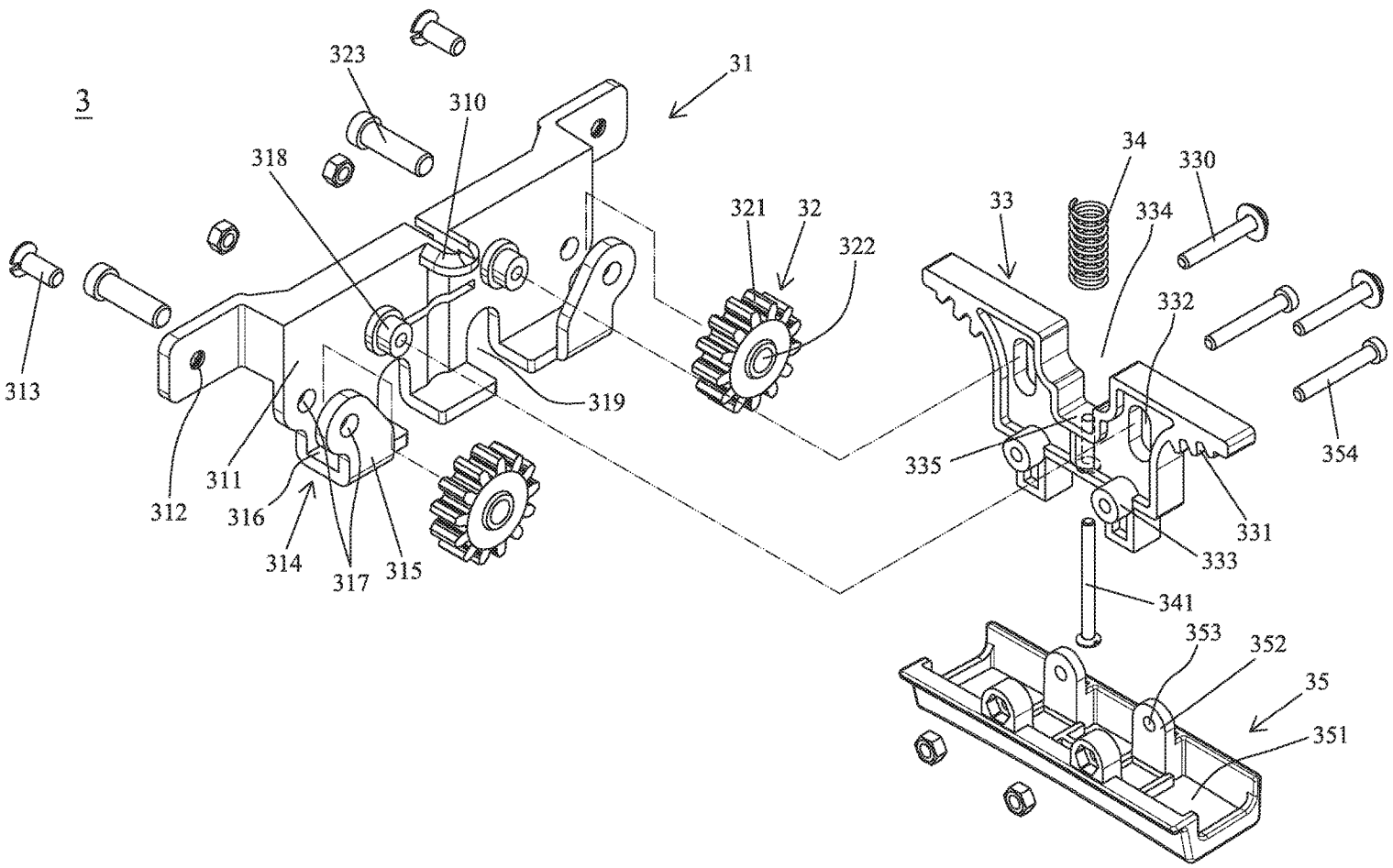
FIG. 2 is an exploded, perspective view of an adjusting device of the backrest height adjusting assembly of FIG. 1.
Figure 3:
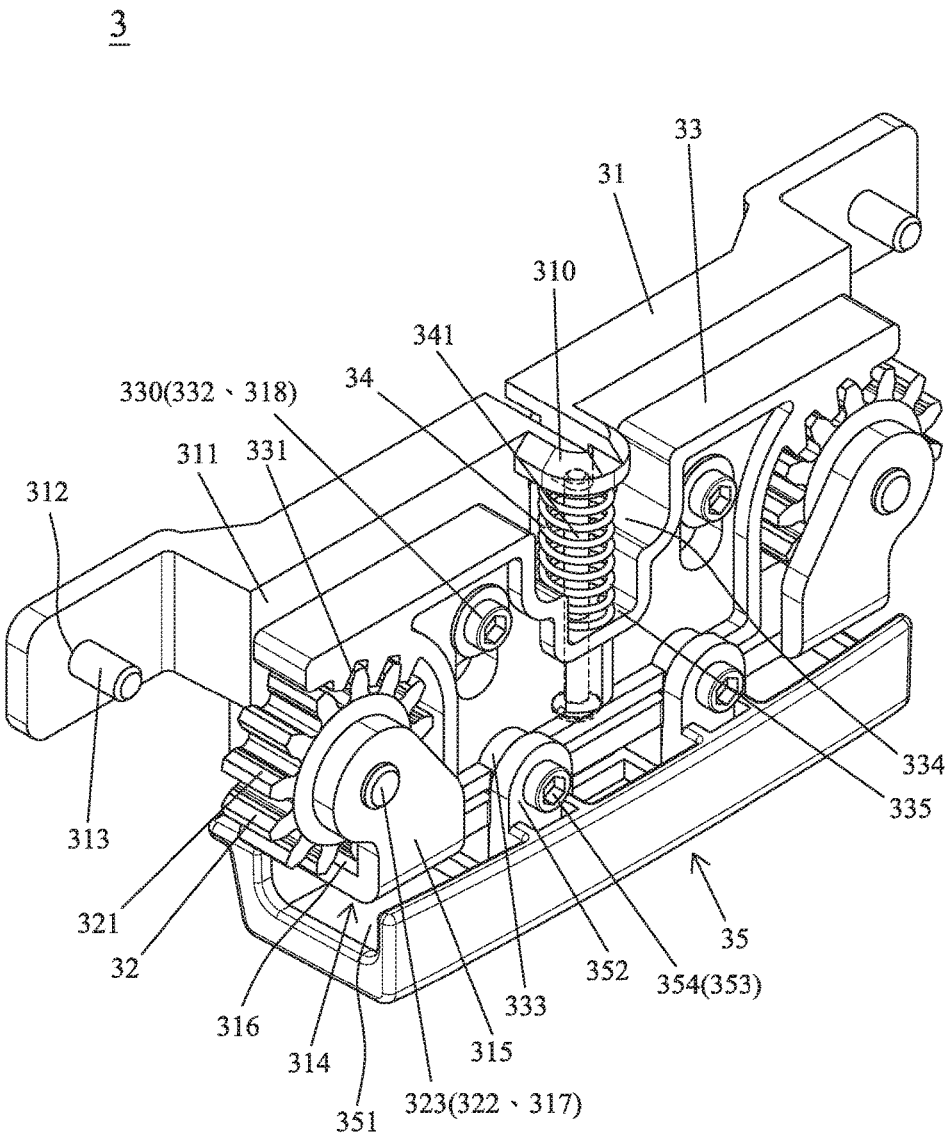
FIG. 3 is a perspective view of the adjusting device of FIG. 2 after assembly.

With reference to FIGS. 1-3, a backrest height adjusting assembly of an embodiment according to the present invention includes a fixing seat 1, a backrest 2, an adjusting device 3, and a waist rest 4. The fixing seat 1 includes a lower end having a coupling portion 11 adapted to be fixed in relation to a chair seat of a chair. The coupling portion 11 can be fixed to the chair seat, a chassis plate mounted to a bottom side of the chair seat, or a top end of a base of the chair. The fixing seat 1 includes two fixing posts 12 extending in a vertical direction and parallel to each other. Each of the two fixing posts 12 includes an inner face having a plurality of positioning grooves 12 spaced from each other in the vertical direction. The inner faces of the two fixing posts 12 face each other. Furthermore, each of the two fixing posts 12 includes a groove 122 disposed above the plurality of positioning grooves 121 thereof and having a width larger than a width of each of the plurality of positioning grooves 121.

The backrest 2 includes a frame 21 having a coupling seat 22 at a central portion thereof for coupling with the fixing seat 1. The coupling seat 22 includes two coupling sleeves 23 symmetrically disposed and respectively coupled with the two fixing posts 12. Each of the two coupling sleeves 23 includes a coupling hole 231 extending in the vertical direction and having a lower end with an opening 232 through which one of the two fixing posts extends. A notch 233 is defined in a lower end of a sidewall of each of the two coupling sleeves 23 and intercommunicates with the coupling hole 231. The coupling seat 22 includes a coupling portion 24. The coupling seat 22 of the backrest 2 includes a front side having two insertion portions 25. Each of the two insertion portions 25 includes a plurality of insertion holes 251 spaced from each other in the vertical direction. In this embodiment, each of the two insertion portions 25 includes four insertion holes 251.

The adjusting device 3 is securely mounted to the coupling portion 24 of the backrest 2 and includes a fixing block 31, two gears 32, a movable block 33, an elastic element 34, and an actuation block 35. The fixing block 31 includes a main plate 311 having two fixing holes 312 respectively at two sides thereof. Two fasteners 313 extend through the two fixing holes 312 to couple with the coupling portion 24 of the backrest 2. The main plate 311 further includes two pivotal portions 314 respectively disposed on two sides thereof. Each of the two pivotal portions 314 includes a pivotal plate 315 extending rearward from a rear surface of the main plate 311 and then extending parallel to and spaced from the rear surface of the main plate 311. Each pivotal plate 315 and the rear surface of the main plate 311 have a receiving groove 316 therebetween. The main plate 311 further has two pivot holes 317. Each pivotal plate 315 has a pivot hole 317 aligned with one of the two pivot holes 317 of the main plate 311. The main plate 311 further includes two guiding pegs 318 on a rear surface thereof and two elongated guiding grooves 319 in a bottom side thereof. Furthermore, an upper abutting portion 310 protrudes rearward from a central portion of the rear surface of the main plate 311.

The two gears 32 are symmetrically disposed. Each of the two gears 32 includes a plurality of teeth 321 on an outer periphery thereof and an axial hole 322 in a center thereof. Each of the two gears 32 is received in one of the receiving grooves 316 of the fixing block 31. The two gears 32 are respectively and rotatably mounted to one of the two pivotal portions 314 of the fixing block 31 by extending two pins 323 through the two pivot holes 317 of the main plate 311, the axial holes 322 of the two gears 32, and the pivot holes 317 of the pivotal plates 315, respectively. A portion of the plurality of teeth 321 of each of the two gears 32 extends through the notch 233 of one of the two coupling sleeves 23 and is coupled with a portion of the plurality of positioning grooves 121 of the fixing seat 1.

The movable block 33 is movable in the vertical direction relative to the fixing block 31. The movable block 33 is in the form of a plate and includes two shoulders. Each of the two shoulders of the movable block 33 includes a bottom side having a toothed portion 331. The toothed portion 331 of each of the two shoulders meshes with a portion of the plurality of teeth 321 of one of the two gears 32. Furthermore, the movable block 33 includes two elongated guiding slots 332 and two stubs 333. The two guiding pegs 318 are slideably received in the two elongated guiding slots 332, and the two stubs 333 are slideably received in the two elongated guiding grooves 319. Two fasteners 33 extend through the two elongated guiding slots 332 and are coupled with the two guiding pegs 318, respectively. Thus, the movable block 33 can stably move in the vertical direction, because the two guiding pegs 318 move along the two elongated guiding slots 332 and the two stubs 33 move along the two elongated guiding grooves 319. Furthermore, the movable block 33 includes a central portion having an upper end with a recessed portion 334. The recessed portion 334 has a lower abutting portion 335.

The elastic element 34 biases the movable block 33 to move relative to the fixing block 31 and biases the toothed portions 331 of the movable block 33 to mesh with the gears 32 to retain the backrest 2 in a selected height relative to the fixing seat 1. In this embodiment, the elastic element 34 is a compression spring and is received in the recessed portion 334 of the movable block 33. The elastic element 34 includes upper and lower ends respectively abutting the upper abutting portion 310 and the lower abutting portion 335. A fixing rod 341 extends through the upper abutting portion 310, the elastic element 34, and the lower abutting portion 334 to position the elastic element 34.

The actuation block 35 is mounted below the fixing block 31 and the movable block 33. The actuation block 35 includes a receiving space 351 in an upper side thereof. A bottom of the fixing block 31 and a bottom of the movable block 33 are received in the receiving space 351. The actuation block 35 further includes two tabs 352 extending upward from a wall of the receiving space 351. Each of the two tabs 352 has a through-hole 353. Two fasteners 354 respectively extend through the two stubs 333 of the movable block 33 and the through-holes 353 of the two tabs 352, permitting joint movement of the actuation block 35 and the movable block 33. The actuation block 33 provides convenient manual operation and assembly quality.

The waist rest 4 includes an abutment plate portion 41 and a connecting portion 42. The connecting portion 42 includes a front side connected to the abutment plate portion 41. The abutment plate portion 41 includes a first plate 411 and a second plate 412. The first plate 411 and the second plate 412 have different curvatures. The first plate 411 and the second plate 412 are arranged in the vertical direction. The connecting portion 42 is mounted between the first plate 411 and the second plate 412. A first connecting plate 421 and a second connecting plate 422 protrude from the front side of the connecting portion 42 and are respectively connected to the first plate 411 and the second plate 412. A spacing between the first and second connecting plates 421 and 422 increases forward from rear ends toward front ends of the first and second connecting plates 421 and 422. The rear ends of the first connecting plate 421 and the second connecting plate 423 are connected by an engagement piece 423. At least one insertion peg 424 is disposed at a rear side of the engagement piece 423. The number of the at least one insertion peg 424 is smaller than the number of the plurality of insertion holes 251. The at least one insertion peg 424 is selectively engaged with at least one of the plurality of insertion holes 251 to selectively fix the waist rest 4 in a selected height relative to the backrest 2. In this embodiment, the waist rest 4 includes two insertion pegs 424 on each of two sides thereof.

Figure 4:
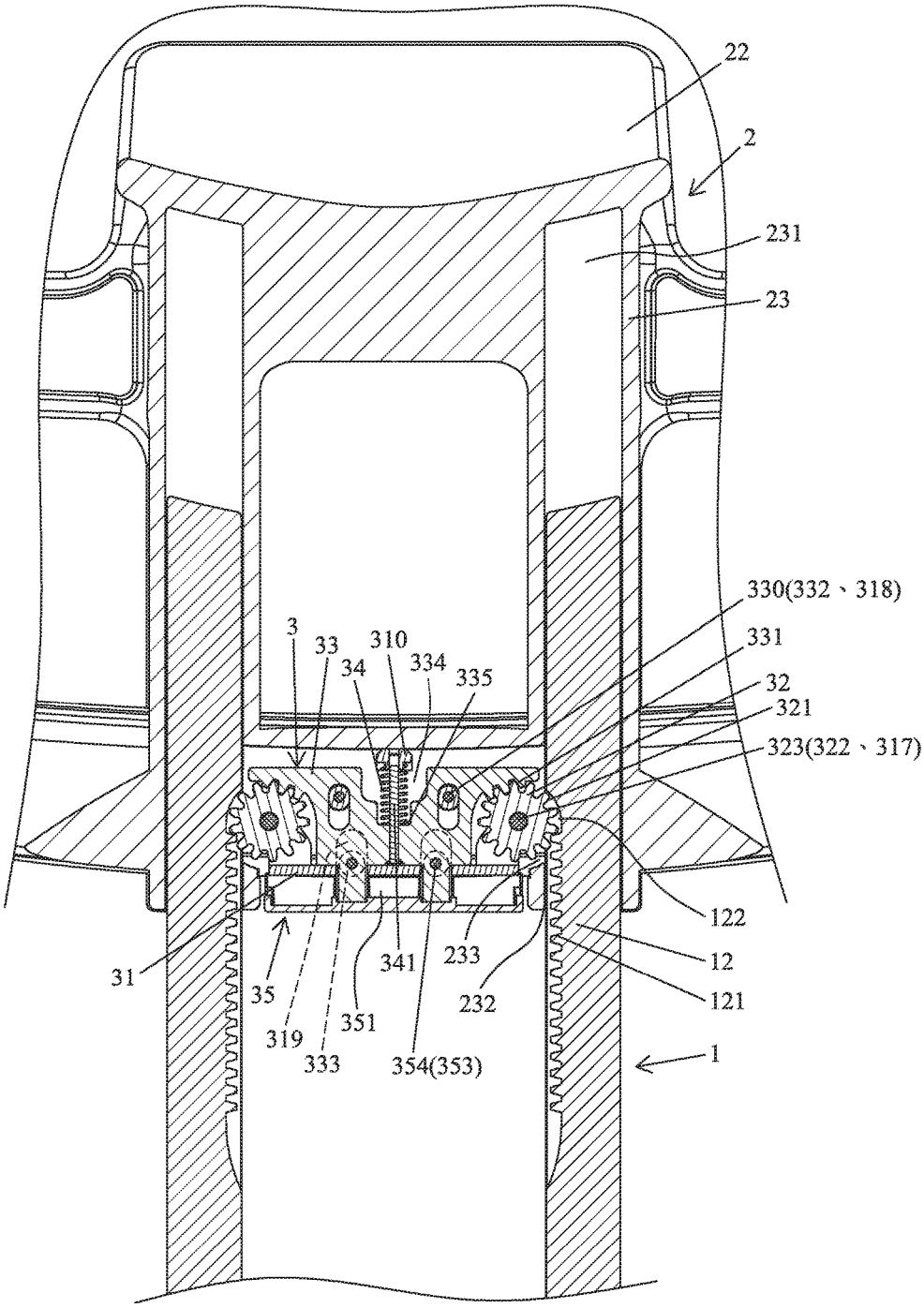
FIG. 4 is a partial, cross sectional view of the backrest height adjusting assembly of FIG. 1 after assembly.

With reference to FIGS. 1 and 4, in assembly, the components of the adjusting device 3 are assembled first. The coupling holes 231 of the two coupling sleeves 23 of the backrest 2 are coupled with upper ends of the two fixing posts 12 of the fixing seat 1. Each notch 233 is aligned with the groove 122 of one of the two fixing posts 12. The fasteners 313 extend through the fixing holes 312 of the fixing block 31 to couple with the coupling portion 24 of the backrest 2. Some of the plurality of teeth 321 of each of the two gears 32 is received in the groove 122 of one of the two fixing posts 12 when the backrest 2 is in the highest position relative to the fixing seat 1. Each of the two fixing posts 12 does not include recessed portions above the groove 122 thereof to assure that the backrest 2 cannot move upward to disengage from the fixing seat 1.

Figure 5:
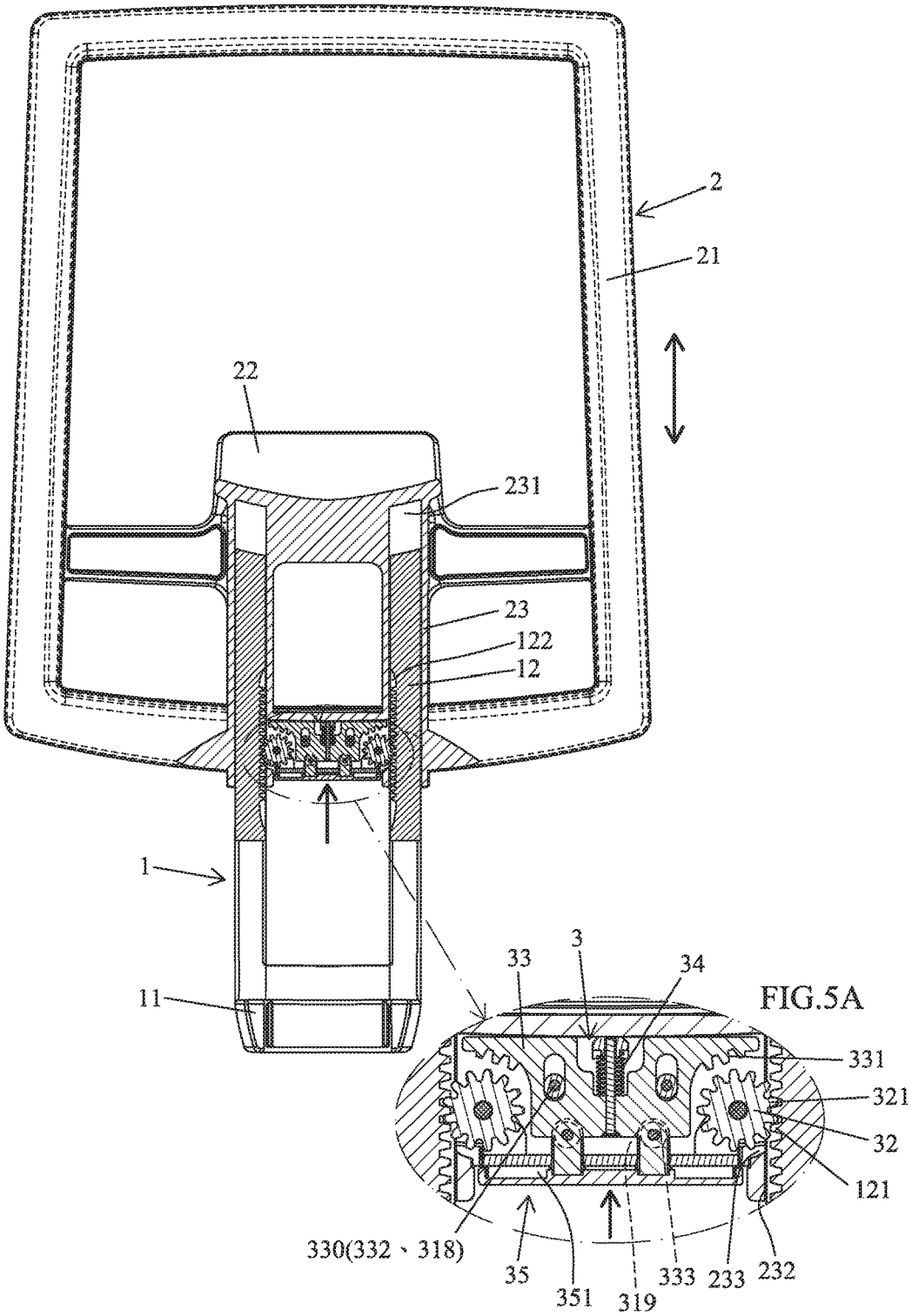
FIG. 5 is a cross sectional view illustrating adjustment of a height of a backrest according to the present invention.

With reference to FIGS. 5 and 5A, when it is desired to adjust the height of the backrest 2, the actuation block 35 is pressed to disengage the toothed portions 331 of the movable block 33 from the plurality of teeth 321 of the two gears 32, such that the two gears 32 are rotatable. Then, the backrest 2 can be moved in the vertical direction relative to the fixing seat 1, and the plurality of teeth 32 of each of the two gears 32 moves along the plurality of positioning grooves 121 of one of the two fixing posts 12.

Figure 6:
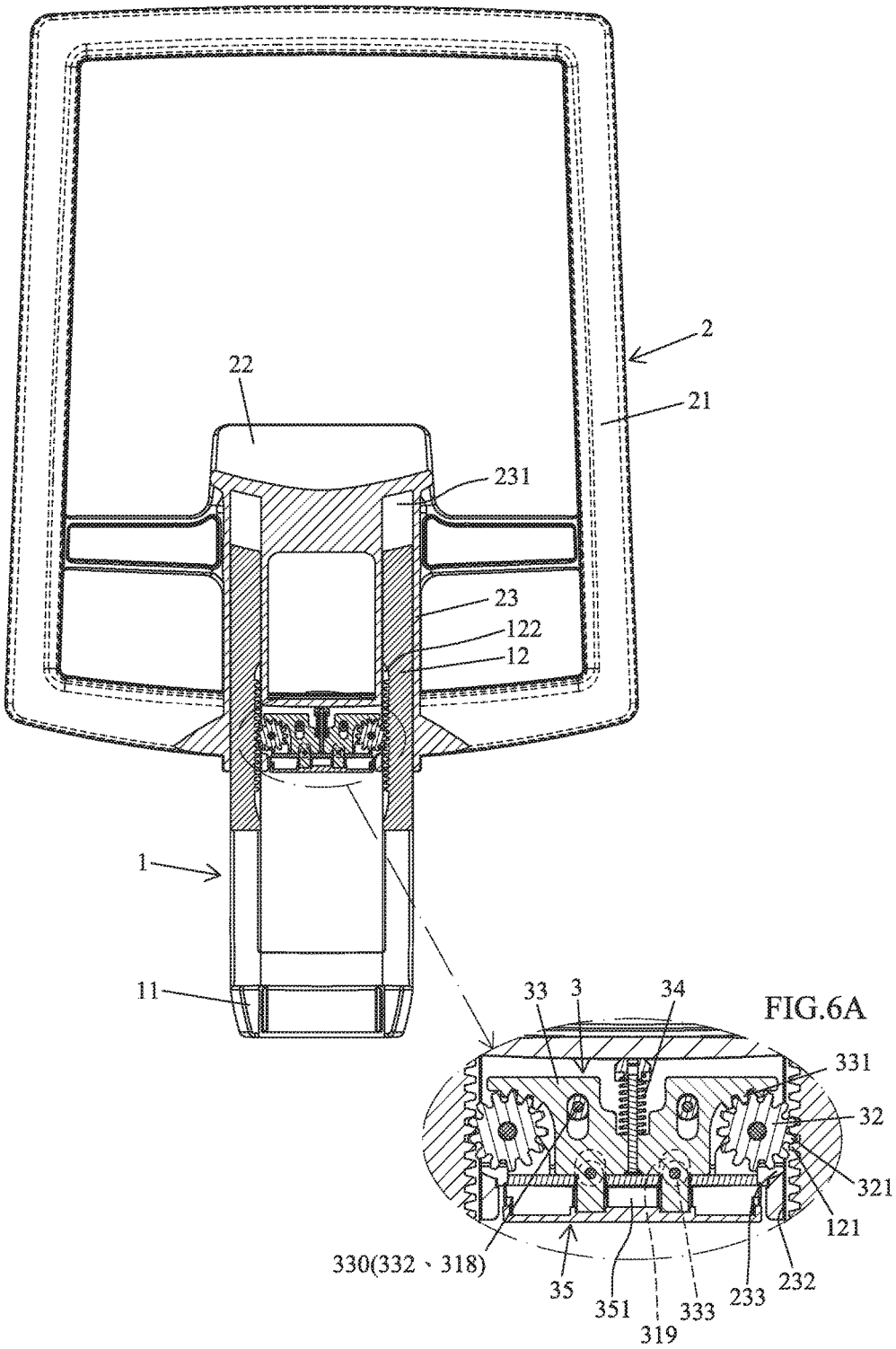
FIG. 6 is a view similar to FIG. 5, illustrating a positioning effect of the backrest height adjusting assembly according to the present invention.

With reference to FIGS. 6 and 6A, after the height of the backrest 2 has been adjusted, the actuation block 35 is released, the elastic force of the elastic element 34 moves the movable block 33 downward to engage the toothed portions 331 with the two gears 32. Furthermore, a portion of the plurality of teeth 321 of each of the two gears 32 meshes with a portion of the plurality of positioning grooves 121 of one of the fixing posts 12 to retain the backrest 2 in the selected height. The two gears 32 couple with the two fixing posts 12 to improve the stable assembly between the backrest 2 and the fixing seat 1. Furthermore, when the movable block 3 moves in the vertical direction, the two guiding pegs 318 are guided by the two elongated guiding slots 332, and the two stubs 333 are guided by the two elongated guiding grooves 319, improving stable movement of the movable block 33.

Figure 7:
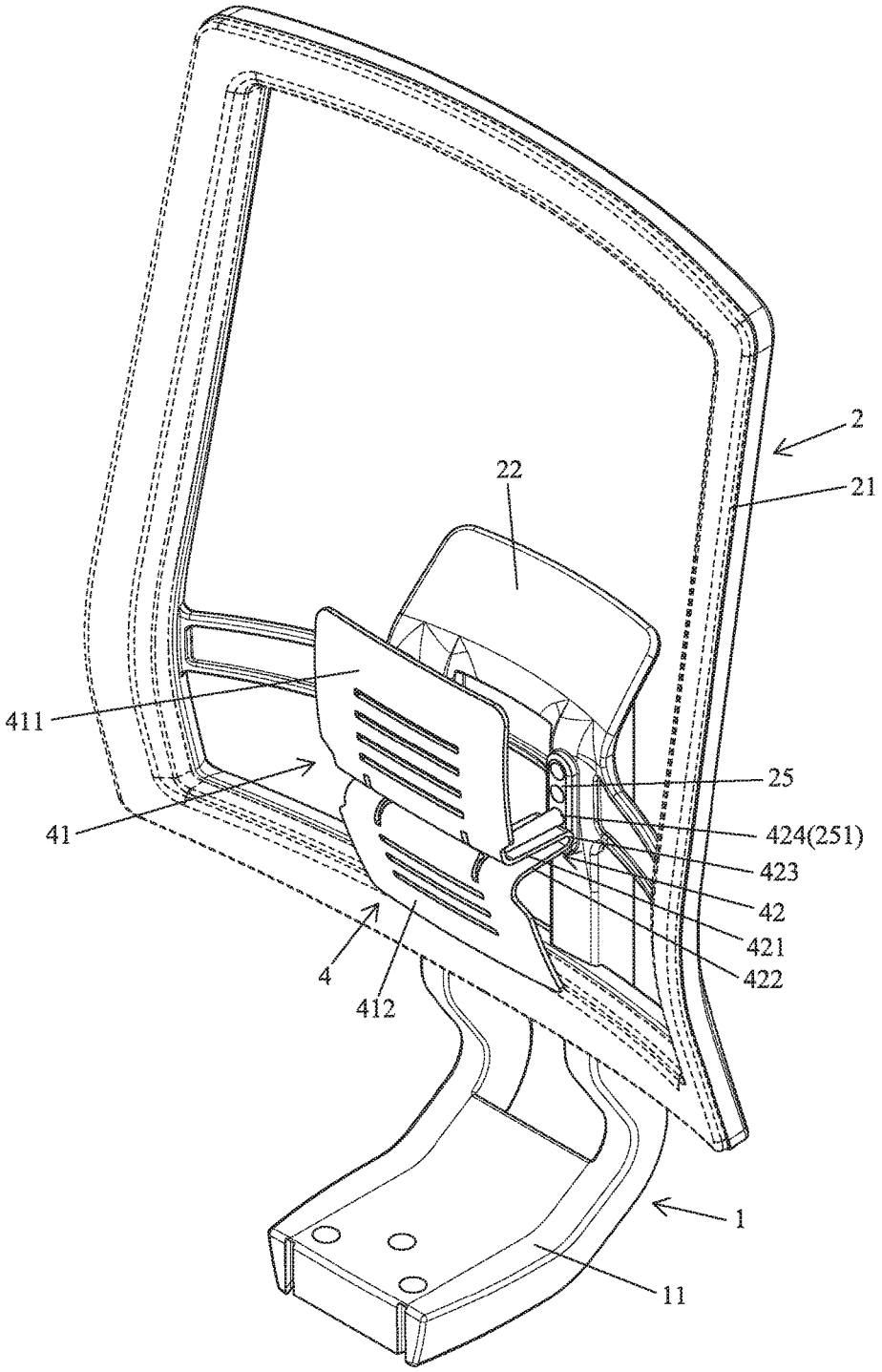
FIG. 7 is a perspective view of the backrest height adjusting assembly of FIG. 1 after assembly.
Figure 8:
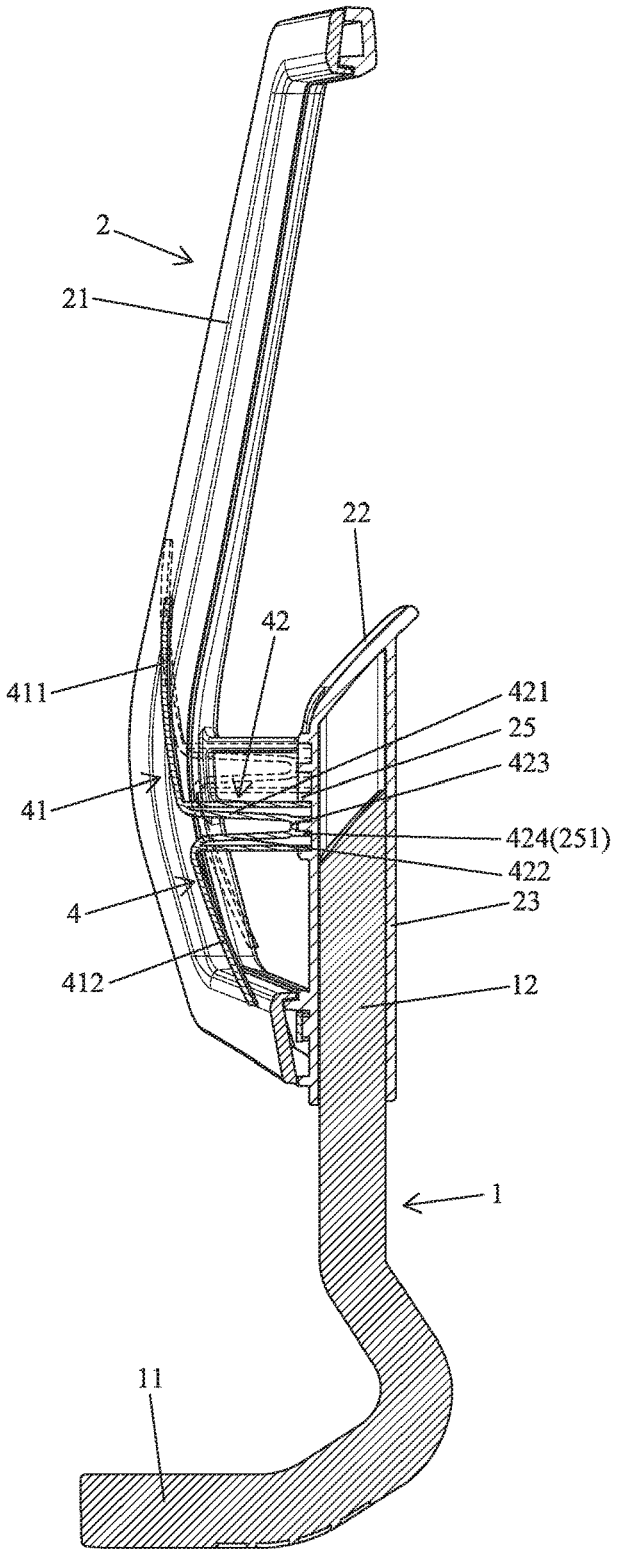
FIG. 8 is a cross sectional view of the backrest height adjusting assembly of FIG. 7.
Figure 9:
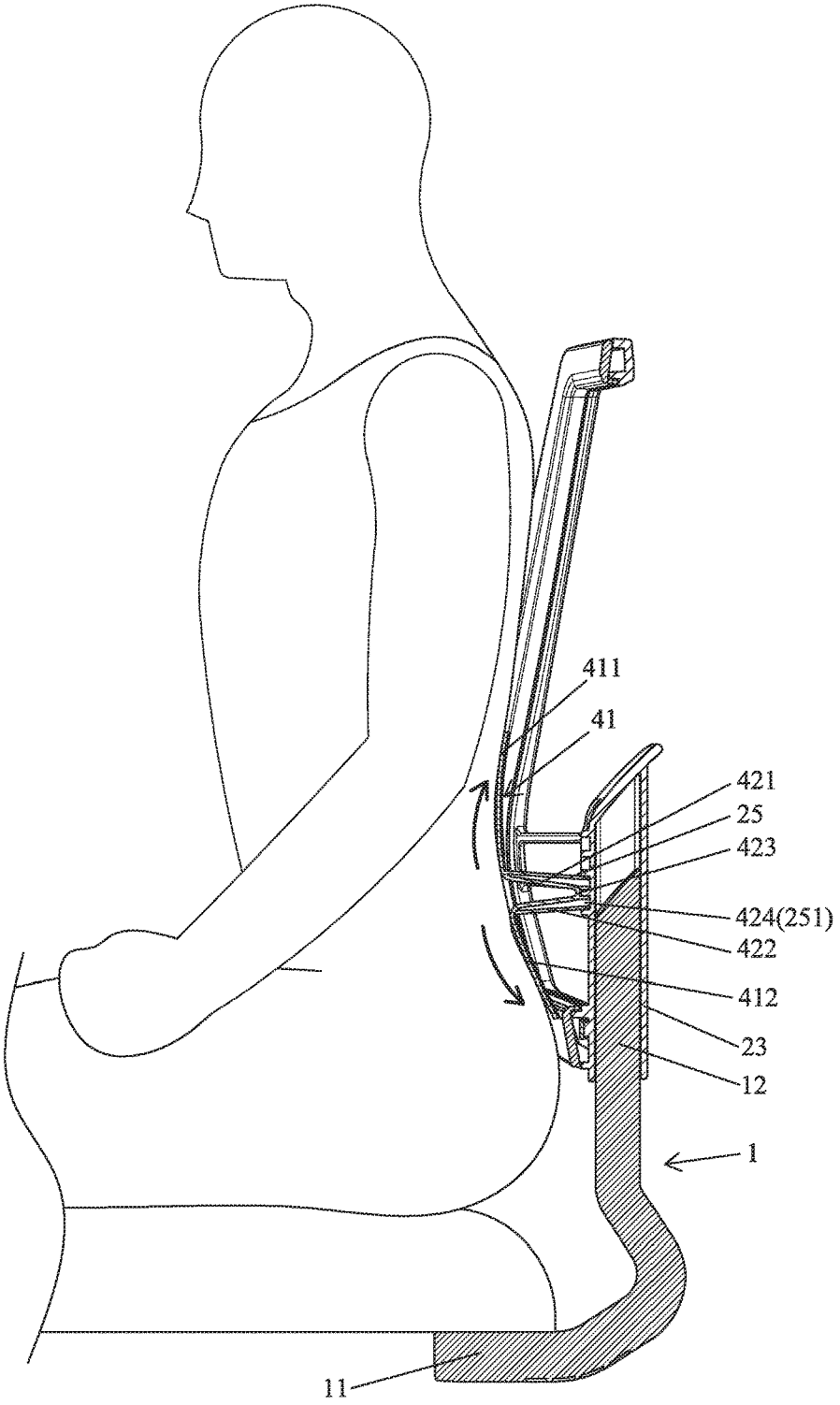
FIG. 9 is a view similar to FIG. 8, illustrating movement of the waist rest during use.
Figure 10:
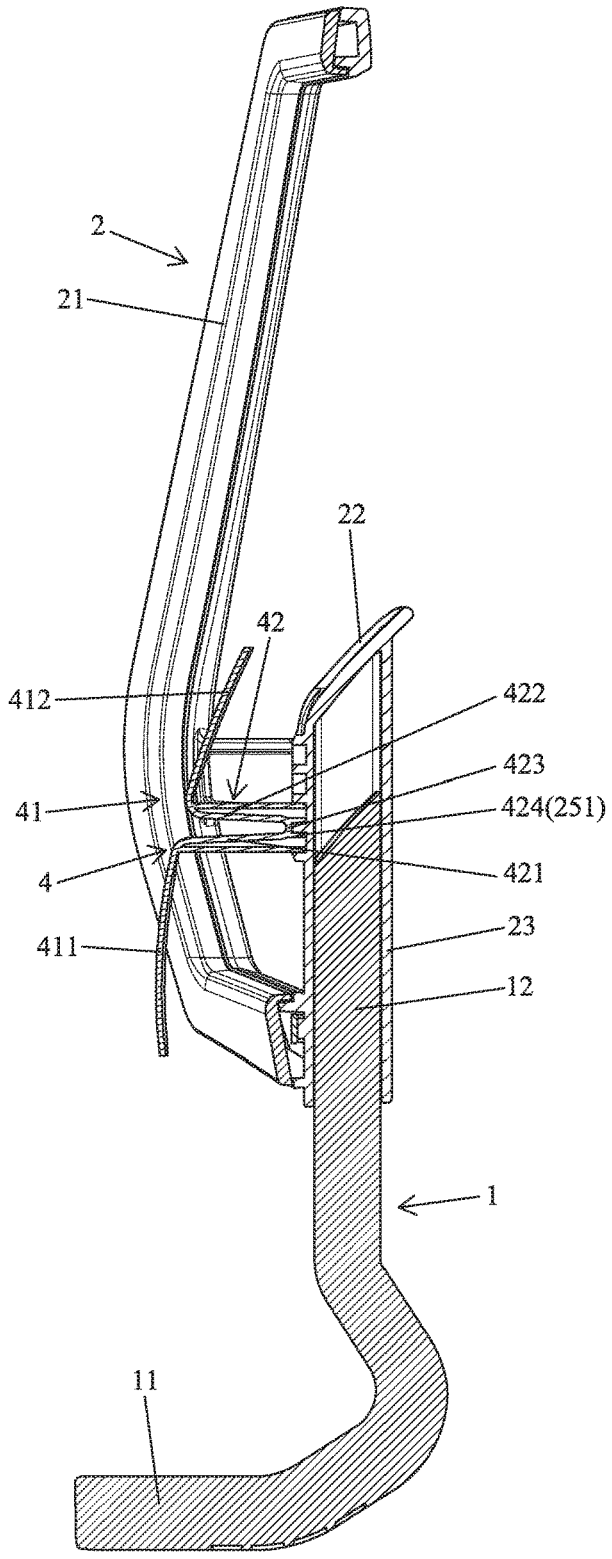
FIG. 10 is a view similar to FIG. 8, illustrating adjustment of the waist rest.

With reference to FIGS. 7 and 8, the insertion pegs 424 are inserted into selected insertion holes 251 to adjust the height of the waist rest 4 relative to the backrest 2. With reference to FIG. 9, since the spacing between the front ends of the first and second connecting plates 421 and 422 is larger than the spacing between the rear ends of the first and second connecting plates 421 and 422, the first and second connecting plates 421 and 422 can expand resiliently to provide improved supporting elasticity and comfort. Furthermore, the first and second plates 411 and 412 have different curvatures, such that the waist rest 4 can be rotated 180°, and the insertion pegs 424 can be coupled with different insertion holes 251 of the backrest 2 to adjust the height of the waist rest 4 relative to the backrest 2. Thus, the waist rest 4 can provide various combinations in relation to the backrest 2, providing wider applications.

Although specific embodiments have been illustrated and described, numerous modifications and variations are still possible without departing from the scope of the invention. The scope of the invention is limited by the accompanying claims.

The invention claimed is:

1. A backrest height adjusting assembly comprising:

a fixing seat including a lower end having a coupling portion adapted to be fixed in relation to a chair seat, wherein the fixing seat includes at least one fixing post extending in a vertical direction, wherein the at least one fixing post includes a plurality of positioning grooves spaced from each other in the vertical direction;

a backrest including a frame having a coupling seat at a central portion thereof for coupling with the fixing seat, wherein the coupling seat includes at least one coupling sleeve coupled with the at least one fixing post, wherein the at least one coupling sleeve includes a coupling hole extending in the vertical direction and having a lower end with an opening through which the at least one fixing post extends, wherein the at least one coupling sleeve includes a sidewall having a notch intercommunicated with the coupling hole and aligned with the plurality of positioning grooves of the at least one fixing post, and wherein the coupling seat includes a coupling portion;

an adjusting device including a fixing block, at least one gear, a movable block, and an elastic element, wherein the fixing block is mounted to the coupling portion of the backrest and includes at least one pivotal portion, wherein the at least one gear includes a plurality of teeth on an outer periphery thereof and is rotatably mounted to the at least one pivotal portion of the fixing block, wherein a portion of the plurality of teeth extends through the notch of the at least one coupling sleeve and is coupled with a portion of the plurality of positioning grooves of the fixing seat, wherein the movable block is movable in the vertical direction relative to the fixing block and includes a toothed portion, wherein the elastic element biases the movable block to move relative to the fixing block and biases the toothed portion of the movable block to mesh with the at least one gear to retain the backrest in a selected height relative to the fixing seat, wherein the movable block is actuatable to disengage the toothed portion from the plurality of teeth of the at least one gear to thereby permit the backrest to move in the vertical direction relative to the fixing seat, permitting height adjustment of the backrest relative to the fixing seat.

2. The backrest height adjusting assembly as claimed in claim 1, wherein the at least one fixing post of the fixing seat includes two fixing posts parallel to each other, wherein each of the two fixing posts includes an inner face having the plurality of positioning grooves, wherein the inner faces of the two fixing posts face each other, wherein the at least one coupling sleeve of the coupling seat of the backrest includes two coupling sleeves respectively coupled with the two fixing posts, wherein the fixing block includes a main plate, wherein the at least one pivotal portion of the fixing block includes two pivotal portions respectively disposed on two sides of the main plate, wherein the at least one gear includes two gears respectively and rotatably mounted to the two pivotal portions, wherein the plurality of teeth of each of the two gears meshes with the plurality of positioning grooves of one of the two fixing posts, wherein the movable block includes two shoulders, wherein each of the two shoulders of the movable block includes a bottom side having the toothed portion, and wherein the toothed portion of each of the two shoulders meshes with a portion of the plurality of teeth of one of the two gears.

3. The backrest height adjusting assembly as claimed in claim 2, wherein each of the two fixing posts includes a groove disposed above the plurality of positioning grooves thereof and having a width larger than a width of each of the plurality of positioning grooves, and some of the plurality of teeth of each of the two gears are received in the groove of one of the two fixing posts when the backrest is in a highest position relative to the fixing seat.

4. The backrest height adjusting assembly as claimed in claim 3, wherein the main plate of the fixing block includes two guiding pegs on a rear surface thereof, wherein the main plate further includes two elongated guiding grooves in a bottom side thereof, wherein the movable block is in a form of a plate and includes two elongated guiding slots and two stubs, wherein the two guiding pegs are slideably received in the two elongated guiding slots, and wherein the two stubs are slideably received in the two elongated guiding grooves.

5. The backrest height adjusting assembly as claimed in claim 4, wherein the adjusting device further includes an actuation block mounted below the fixing block and the movable block, wherein the actuation block includes a receiving space in an upper side thereof, wherein a bottom of the fixing block and a bottom of the movable block are received in the receiving space, wherein the actuation block further includes two tabs extending upward from a wall of the receiving space, wherein each of the two tabs has a through-hole, and wherein two fasteners respectively extend through the two stubs of the movable block and the through-holes of the two tabs, permitting joint movement of the actuation block and the movable block.

6. The backrest height adjusting assembly as claimed in claim 3, wherein the main plate includes an upper abutting portion protruding from the rear surface of the main plate, wherein the movable block further includes a central portion having an upper end with a recessed portion, wherein the recessed portion has a lower abutting portion, wherein the elastic element is a compression spring and is received in the recessed portion of the movable block, wherein the elastic element includes upper and lower ends respectively abutting the upper abutting portion and the lower abutting portion, and wherein a fixing rod extends through the upper abutting portion, the elastic element, and the lower abutting portion to position the elastic element.

7. The backrest height adjusting assembly as claimed in claim 3, wherein each of the two pivotal portions of the fixing block includes a pivotal plate extending parallel to and spaced from the rear surface of the main plate, wherein each pivotal plate and the rear surface of the main plate have a receiving groove therebetween, wherein the main plate has two pivot holes, wherein each pivotal plate has a pivot hole aligned with one of the two pivot holes of the main plate, wherein the two gears are respectively received in the receiving grooves, wherein each of the two gears has an axial hole in a center thereof, and wherein two pins respectively extend through the two pivot holes of the main plate, the axial holes of the two gears, and the pivot holes of the pivotal plates.

8. The backrest height adjusting assembly as claimed in claim 1, further comprising a waist rest, wherein the coupling seat of the backrest includes a front side having two insertion portions, wherein each of the two insertion portions includes a plurality of insertion holes spaced from each other in the vertical direction, wherein the waist rest includes an abutment plate portion and a connecting portion, wherein the connecting portion includes a front side connected to the abutment plate portion, wherein the connecting portion further includes at least one insertion peg, wherein a number of the at least one insertion peg is smaller than a number of the plurality of insertion holes, and wherein the at least one insertion peg is selectively engaged with at least one of the plurality of insertion holes to selectively fix the waist rest in a selected height relative to the backrest.

9. The backrest height adjusting assembly as claimed in claim 8, wherein the abutment plate portion includes a first plate and a second plate, wherein the first plate and the second plate are arranged in the vertical direction, wherein the connecting portion is mounted between the first plate and the second plate, wherein a first connecting plate and a second connecting plate protrude from a front side of the connecting portion and are respectively connected to the first plate and the second plate, wherein a spacing between the first connecting plate and the second connecting plate increases forward from rear ends toward front ends of the first and second connecting plates, wherein the rear ends of the first connecting plate and the second connecting plate are connected by an engagement piece, and wherein the at least one insertion peg is disposed at a rear side of the engagement piece.

* * * * *